US005511605A

United States Patent [19]

Iwamoto

[11] Patent Number: 5,511,605

[45] Date of Patent: Apr. 30, 1996

[54] METHOD AND APPARATUS FOR VACUUM DIE CASTING

[75] Inventor: Norihiro Iwamoto, Zama, Japan

[73] Assignee: Toshiba Kikai Kabushiki Kaisha, Tokyo, Japan

[21] Appl. No.: 271,603

[22] Filed: Jul. 7, 1994

[30] Foreign Application Priority Data

Jul. 7, 1993 [JP] Japan ..... 5-168135

[51] Int. Cl.[6] ..... B22D 17/32

[52] U.S. Cl. ..... 164/457; 164/113; 164/155.3; 164/155.4; 164/305

[58] Field of Search ..... 164/457, 155.3, 164/155.4, 312, 113, 305

[56] References Cited

U.S. PATENT DOCUMENTS 5,022,457 6/1991 Iwamoto et al. ..... 164/457

*Primary Examiner*—Kuang Y. Lin
*Attorney, Agent, or Firm*—Fish & Richardson

[57] ABSTRACT

A vacuum-controlling system for controlling the degree of vacuum in the vacuum system of a vacuum die-casting machine operates to: detect the degree of vacuum H at the instant of closure of the vacuum valve to the die mold cavity; compare the detected degree of vacuum H with a preset degree of vacuum Ho; correct a first position of the injection plunger for opening the vacuum valve by moving the first position in the advancing direction of the plunger by a specific distance in the case where H is higher than Ho; and correct the first position in the retracting direction of the plunger by a specific distance in the case where H is lower than Ho. By thus automatically correcting the position of the plunger for opening the vacuum valve to the optimum state, the formation of cavities or blowholes in the die-cast product is prevented, and at the same time, by maintaining the degree of vacuum in a specific state, the product quality is stabilized.

11 Claims, 5 Drawing Sheets

METHOD AND APPARATUS FOR VACUUM DIE CASTING

BACKGROUND OF THE INVENTION

This invention relates generally to vacuum die casting and more particularly to a die-casting method in which, by controlling the degree of vacuum in the cavity within the casting mold within a specific range, formation of blowholes in the casting due to gas being swept into the cavity during injection thereinto of molten metal to be cast is prevented, thereby contributing to stabilization of the product quality of the cast articles. The invention also relates to a die-casting apparatus for practicing this method.

The principal component of a vacuum die-casting machine, in general, is a metal die mold having a cavity therein for forming a cast product or casting. The cavity is connected at its one end via a vacuum valve and a vacuum piping to a vacuum creating means. A vacuum gage is installed in the vacuum piping to indicate visually the degree of vacuum therein. The degree of vacuum within the cavity is controllable by the opening and closing of the vacuum valve. The cavity communicates at an opposite end thereof to the inner end of an injection sleeve. An injection plunger is slidably fitted in the sleeve and is operable therewith to inject molten metal or melt, to be die cast, into the cavity. The injection plunger has a rod extending out of the sleeve and being drivable by driving means. Detection devices such as limit switches are provided to detect certain critical positions of the rod and to thereby operate a relay for opening and closing the vacuum valve.

In the operation of this vacuum die-casting machine, the plunger is initially at its fully retracted position. Molten metal or melt is poured into the injection sleeve through a melt inlet formed in the sleeve. The plunger is then driven forward to begin injecting the melt into the cavity and close the melt inlet. One detection device is thereupon activated by the rod and, in turn, activates the relay. The relay thereby operates to energize a solenoid to open the vacuum valve. Thus reduction of the pressure within the cavity begins while the plunger continues to advance further, causing the melt to fill the cavity. Immediately before the cavity is completely filled with the melt, a second detection device is activated by the plunger rod, whereby the relay operates to close the vacuum valve. In this manner the melt is forced to rapidly fill the cavity in a state of amply reduced pressure. The structure composition and operation of a typical example of such a vacuum die-casting machine and its operating control means will be described in detail hereinafter in conjunction with a drawing.

In the control means of the prior art for operating a vacuum die-casting machine, the timing of the opening and closing of the vacuum valve is interlocked with only the mechanical movement of the rod of the injection plunger and is independent of the supervisory control of the degree of vacuum in the cavity. For this reason there is the possibility of gas being sucked into the cavity as it is swept in together with the melt. More specifically, in a case such as that wherein the vacuum valve is opened prematurely when the liquid surface of the melt within the injection sleeve is lower than the centerline of the sleeve, a gap which is not sealed by a portion of the melt exists between the inner wall surface of the sleeve and the outer peripheral surface of the plunger. Consequently, a large quantity of outside air flows through this gap into the interior of the sleeve. Thus, as melt is sucked into the cavity, it entraps and sweeps this air into the cavity. This air-infiltration phenomenon gives rise to the formation of cavities or blowholes in the resulting casting. Thus it becomes a cause of degradation of the product quality.

Furthermore, the timing of the opening and closing of the vacuum valve is established by only the positional relationships between the detection devices and the rod of the injection plunger. For this reason, adjustment of this timing cannot be carried out during the operation of the die-casting machine.

In addition to this timing, the supervisory control of the degree of vacuum applied to the cavity is also an important factor for stabilizing the quality of the cast products. Heretofore, however, control of this timing and control of the degree of vacuum have been carried out separately and independently. Especially with respect to control of the degree of vacuum, this control has been carried out exclusively by visual supervision with the use of a vacuum gage.

SUMMARY OF THE INVENTION

Accordingly, it is a general object of this invention to provide a method and apparatus for vacuum die casting in which the above described problems encountered in the related prior art have been overcome, and by which the position of the injection plunger for opening the vacuum valve is automatically adjusted into an optimum state, whereby formation of blowholes in the cast product is prevented, and at the same time, the degree of vacuum is maintained in a required state thereby to stabilize the product quality.

The above stated object has been achieved by this invention according to which, in one aspect thereof, there is provided a method of vacuum die casting in a vacuum die-casting machine having a vacuum die-casting mold with a cavity formed therein, a vacuum system communicating with the cavity via a vacuum valve, and an injection plunger which is movable in an advancing direction and stroke for injecting molten metal to be die cast into the cavity and movable in the opposite retracting direction, said vacuum valve being opened when said injection plunger has advanced to a first position and being closed when the injection plunger has advanced further to a second position, which method comprises:

- detecting the degree of vacuum H of the vacuum system at the instant when the vacuum valve is closed;
- comparing the degree of vacuum thus detected with a previously set degree of vacuum Ho;
- correcting said first position by moving the same through a specific distance in said advancing direction when the detected degree of vacuum H is higher than said previously set degree of vacuum Ho; and
- correcting said first position by moving the same through a specific distance in said retracting direction when the detected degree of vacuum H is lower than said previously set degree of vacuum Ho.

According to this invention in another aspect thereof, there is provided a vacuum-controlling system for controlling the vacuum in vacuum die casting in a vacuum die-casting machine having a vacuum die-casting mold with a cavity formed therein, a vacuum system communicating with the cavity via a vacuum valve, and an injection plunger which is movable in an advancing direction and stroke for injecting molten metal to be die cast into the cavity and movable in the opposite retracting direction, said vacuum valve being opened when said injection plunger has advance in said injection stroke to a first position and being closed when said injection plunger has advance further to a second position, said vacuum-controlling system comprising:

a vacuum detector for detecting the degree of vacuum in said vacuum system and generating a corresponding detected vacuum output;

a position detector for detecting the position of said injection plunger and generating a corresponding detected position output;

vacuum comparison means operating responsively to said detected vacuum output and said detected position output to compare the degree of vacuum H at the instant when the vacuum valve closes and a previously set degree of vacuum Ho and to generate a corresponding vacuum comparison output; and first-position correcting means operating responsively to said detected position output and said vacuum comparison output to correct said first position through a specific distance in said advancing direction in the case where H is higher than Ho and through a specific distance in said retracting direction in the case where H is lower than Ho.

A further feature of the vacuum-controlling system according to this invention is the provision therein of a shut-off limit detector for detecting the full closure or shut-off state of the vacuum valve, and the degree of vacuum after detection of the shut-off limit is compared with a preset degree of vacuum.

Still another feature of the vacuum-controlling system of this invention is that an alarm generating means for generating an alarm signal and/or a signal for stopping the die-casting machine in the case where the detected degree of vacuum is lower than a limiting degree of vacuum preset beforehand and an alarm emitting device for emitting an alarm upon receiving the alarm signal can be provided. Furthermore it is possible to provide an operationally processing means for processing the variation with time of the degree of vacuum, the velocity of the injection plunger, and parameters indicating the state of the injection cycle on the basis of the output data of the vacuum detector and the output data of the position detector and to provide a display device operating in accordance with the output of the operationally processing means to display a vacuum curve indicating the variation with time of the degree of vacuum, an injection velocity curve indicating the variation with time of the velocity of the injection plunger, and the injection cycle parameters.

In the vacuum-controlling system of this invention, the following features of merit and utility are afforded.

When the detected degree of vacuum is higher than a preset value, the position of the first position of the injection plunger at which the vacuum valve opens is corrected by a specific distance in the advancing direction. Thus the timing of the start of pressure reduction in the cavity by the opening of the vacuum valve is so controlled as to be retarded.

Conversely, when the degree of vacuum has dropped for some reason such as clogging of the filter in the vacuum piping, the position of the injection plunger at which the vacuum valve is opened is corrected in the retracting direction. For this reason the timing for the opening of the vacuum valve is advanced. Therefore, since the pressure reduction in the cavity is started earlier, the degree of vacuum in the cavity can be maintained automatically within a certain specific range.

Still another feature is that when the degree of vacuum drops considerably below the preset value, this condition is detected and an alarm is emitted. Furthermore, from the displays of the curves of the degree of vacuum and the injection velocity of the condition of the injection cycle, the real-time state of the injection cycle can be supervisorily observed.

DETAILED DESCRIPTION

Figure 5:
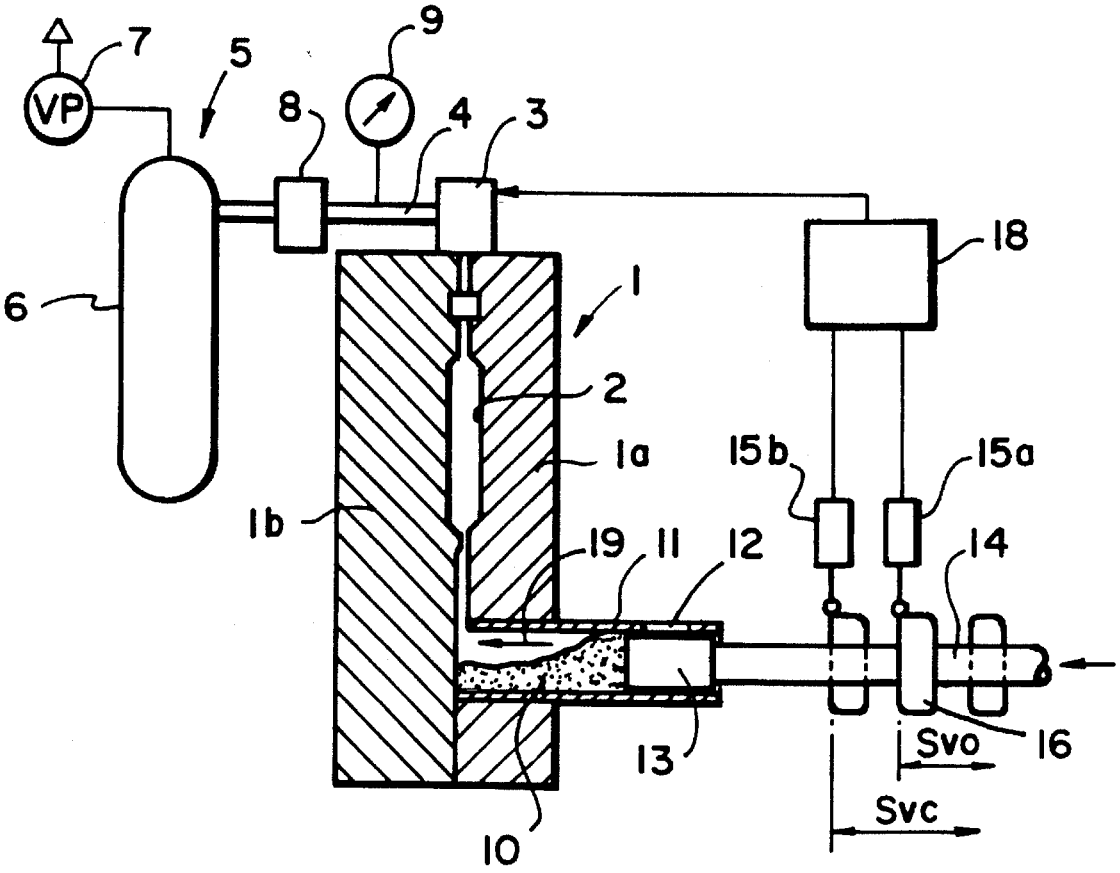
FIG. 5 (PRIOR ART)
FIG. 5 is a system diagram showing the essential organization of one example of a known control system used in vacuum die casting.

As conducive to a full understanding of the present invention, the general nature, attendant problems, and limitations of the prior art relating to vacuum die casting and control thereof will first be considered with reference to FIG. 5.

The principal component of a vacuum die-casting machine, in general, is a metal die mold 1 comprising a stationary or fixed mold la and a movable mold 1*b*, between and by which a cavity 2 is formed. A vacuum valve 3 is communicatively connected to the upper part of the cavity 2 and is connected by way of vacuum piping 4 to a vacuum system or device 5. This vacuum device 5 comprises essentially a vacuum tank 6 and a vacuum pump 7. In the operation of this vacuum device 5, the vacuum pump 7 is operated to maintain the degree of vacuum in the vacuum tank 6 at a specific high value. By opening the vacuum valve 3, the pressure in the cavity 2 is instantly reduced. A filter 8 and a vacuum gage 9 are provided in the vacuum piping 4 between the vacuum tank 6 and the vacuum valve 3. By means of the vacuum gage 9, visual supervision of the degree of vacuum can be carried out.

The lower part of the cavity 2 communicates with the inner end of an injection sleeve 11 for injecting under pressure molten metal (melt) 10 into the cavity 2. The injection sleeve 11 at its inner end is imbeddedly inserted in the fixed mold 1*a* and has an outer part extending outward from the fixed mold 1*a*. This outer part is provided at a specific position with a melt inlet 12. An injection plunger 13 is slidably fitted within the injection sleeve 11 and is fixed to a rod 14 coupled at its outer end an injection cylinder (not shown). This injection cylinder operates to actuate the injection plunger 13 thereby to pressurize the melt 10. Furthermore, in order to interlock the opening and closing action of the vacuum valve 3 with respect to the action of the injection plunger 13, the rod 14 is provided at specific positions thereon with an actuating ring or dog 16 fixed thereto. This dog 16 is thus provided to contact and actuate contact members respectively of a set of limit switches 15*a* and 15*b*. These limit switches are connected to a relay 18.

The conventional vacuum die-casting machine of the essential composition as described above operates in the following manner. First, with the injection plunger 13 at its initial or fully retracted position, molten metal or melt is conveyed by a ladle (not shown) and poured through the melt inlet 12 into the interior of the injection sleeve 11. The rod 14 and the plunger 13 are then driven forward from the initial position through a distance Svo to a first position where the plunger 13 has closed the melt inlet 12. Simultaneously the dog 16 contacts the contact member of the limit switch 15*a*. The limit switch 15*a* is thereby switched ON to transmit a position detection signal to the relay 18. In response to this signal, a contact of the relay 18 is moved to its ON position. A solenoid (not shown) for actuating the vacuum valve 3 is thereby energized and opens the vacuum valve 3. Thus, the cavity 2 and the vacuum tank 6 become communicative by way of the vacuum valve 3. Consequently, reduction of pressure in the cavity 2 is started. Then, together with the advance of the injection plunger 13, the melt 10 begins to fill the cavity 2.

Then, when the injection plunger 13 advances further and reaches a second position at an injection stroke distance Svc from the initial position, the dog 16 contacts the contact member of the limit switch 15*b*. The relay 18 is thus turned OFF. As a result, the vacuum valve 3 is closed immediately before completion of the filling of the cavity 2 with the melt 10. In this manner the melt 10 is introduced rapidly into the cavity 2 in a state of amply reduced pressure.

However, in the prior art control system of the above described composition, the timing of the opening and closing of the vacuum valve 3 is independent of the supervisory control of the degree of vacuum. For this reason there arises the problem of gas being sucked into the cavity 2 as it is swept in together with the melt 10. More specifically, in a case such as that wherein the injection plunger 13 is at a position short of (to the left, as viewed in FIG. 1, of) the melt inlet 12, or, as shown in FIG. 5, in a case such as that wherein the vacuum valve 3 is opened when the liquid surface of the melt within the injection sleeve 11 is lower than the centerline of the injection sleeve 11, the melt 10 is sucked into the cavity 2 as it entraps and sweeps in gas. This phenomenon causes the formation of cavities or blowholes in the resulting casting and thereby becomes a cause of degradation of the product quality.

Furthermore, the timing of the opening and closing of this vacuum valve 3 is established by only the positional relationships between the limit switches 15*a* and 15*b* and the dog 16. Moreover, the time required for the high-speed injection stroke of the injection plunger 13 is an extremely short time, and there is not much difference between this time and the delay time of the action of the solenoid actuating the vacuum valve 3. As a consequence, adjustment of the timing of the opening and closing of the vacuum valve 3 has been extremely difficult. As one technique for adjusting this actuation of the vacuum valve 3, we have proposed a "Control System of Die Cast Machine" disclosed in U.S. Pat. No. 5,022,457.

In addition to this timing of the opening and closing of the vacuum valve 3, the supervisory control of the degree of vacuum is also an important factor for preventing the formation of blowholes and stabilizing the quality of the cast products. That is, it is known that filling the mold cavity with melt while the degree of vacuum is maintained constant is effective for prevention of formation of blowholes. However, the quantity of the melt is not constant at all times. Furthermore, various factors such as errors of the sensor for detecting the degree of vacuum are intertwined, while the injection cycle time is an extremely short time interval of a few seconds. For these reasons, control of the degree of vacuum at a constant value by feeding back the detected value of the degree of vacuum has been difficult. Therefore, with respect to control of the degree of vacuum, this has been carried out exclusively by visual supervision with the use of a vacuum gage 9.

Figure 1:
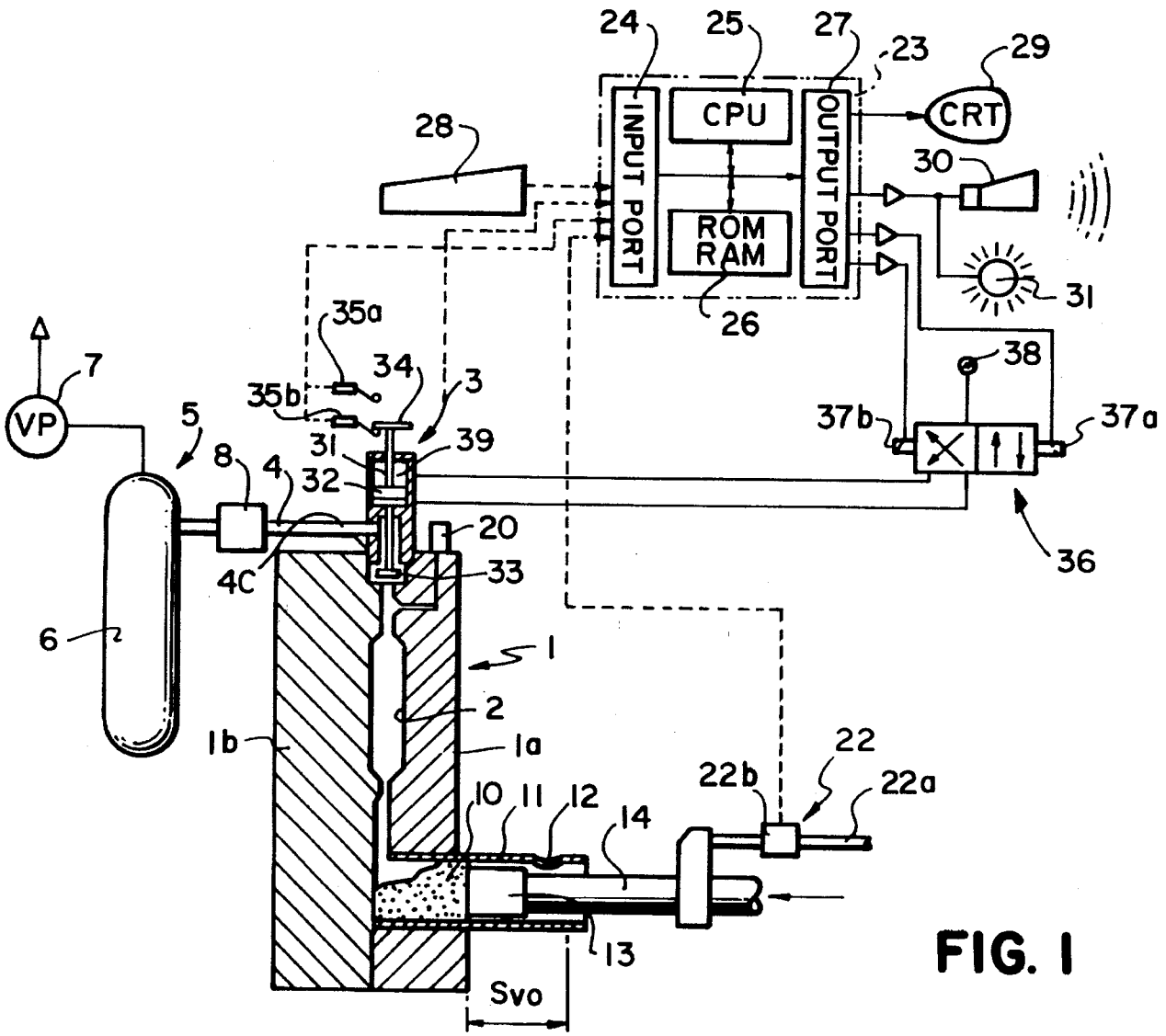
FIG. 1 is a system diagram showing the essential organization of one example of embodiment of a vacuum-controlling system according to this invention as applied to an example of a vacuum die-casting machine shown as a side view in vertical section.

The method and system according to this invention for controlling the degree of vacuum in vacuum die casting, by which the above described limitations and difficulties of the prior art can be overcome, will now be described in detail with respect to a preferred embodiment thereof and with reference to FIGS. 1 through 4. The essential components of a vacuum die-casting machine and one example of the system for controlling the degree of vacuum according to the invention are shown in FIG. 1. In FIG. 1, those component elements which are the same as, or equivalent to, corresponding elements in FIG. 5 are designated by the same reference numerals. Detailed description of such elements will not be repeated.

In this example, the cavity 2 within the mold 1 and the vacuum piping 4 communicating with the vacuum tank 6 are connected by way of the vacuum valve 3, and starting and stopping of suction (evacuation) of the cavity 2 is accomplished by the opening and closing of this vacuum valve 3. A vacuum sensor 20 is provided to detect the degree of vacuum in the vacuum system through a passageway communicating with the cavity 2.

The vacuum valve 3 has a valve casing with a cylinder 39 formed therein and containing a spool 32 slidably fitted therein. The spool 32 is coaxially fixed to an intermediate part of an actuating rod 31. A valve body 33 is fixed to one end of the actuating rod 31 confronting the cavity 2. The other end of the actuating rod 31 extends out of the valve casing and has a dog 34 fixed thereto. The spool 32 is driven in opposite axial movements by fluid pressure supplied selectively into the cylinder 39 on opposite sides of the spool 32 from a fluid pressure source 38 by way of a two-way switch valve 36. Thus, the valve body 33 is also actuated in opening and closing action. The switch valve 36 is controlled by a control device 23 as described hereinafter. Furthermore, for positively and accurately detecting the state of opening and closing of the valve body 33, limit switches 35*a*and 35*b* to be operated in ON/OFF action by the above mentioned dog 34 are disposed at positions respecively corresponding to the opening and closing positions of the valve body 33.

The vacuum piping 4 is connected through an outlet port 40 to the casing of the valve 3 and communicates with the side of the valve body 33 opposite that of the cavity 2. Thus, when the vacuum valve is open, the cavity 2 and the vacuum piping 4 are communicative, whereby the pressure within the cavity can be reduced.

The position of the injection plunger 13 is detected by detection means 22 comprising a magnetic scale 22*a* mounted fixedly on and parallelly to the rod 14 of the injection plunger 13 and a displacement sensor 22*b* for detecting displacement of this magnetic scale 22*a* and thereby outputting a pulse signal proportional to each displacement of the injection plunger 13. The outputs of the vacuum sensor 20, the limit switches 35*a* and 35*b*, and the displacement sensor 22*b* are introduced as input into the above mentioned control device 23.

This control device 23 is provided with a central processing unit (CPU) 25, a main memory device 26 comprising a read-only memory (ROM) in which a program is stored and a random-access memory (RAM) for storing inputted data or process data, an input port 24, and an output port 27. The CPU 25 is connected by way of the input port 24 to the vacuum sensor 20, the limit switch 21, the position sensor 22 and input devices such as a keyboard 28 for inputting set data necessary for vacuum control. To the output port 27, output devices such as a cathode-ray tube (CRT) 29 for displaying curves of various states and the like as will be described hereinafter, a sound alarm device 30, and an alarm lamp 31 are connected.

Figure 2:
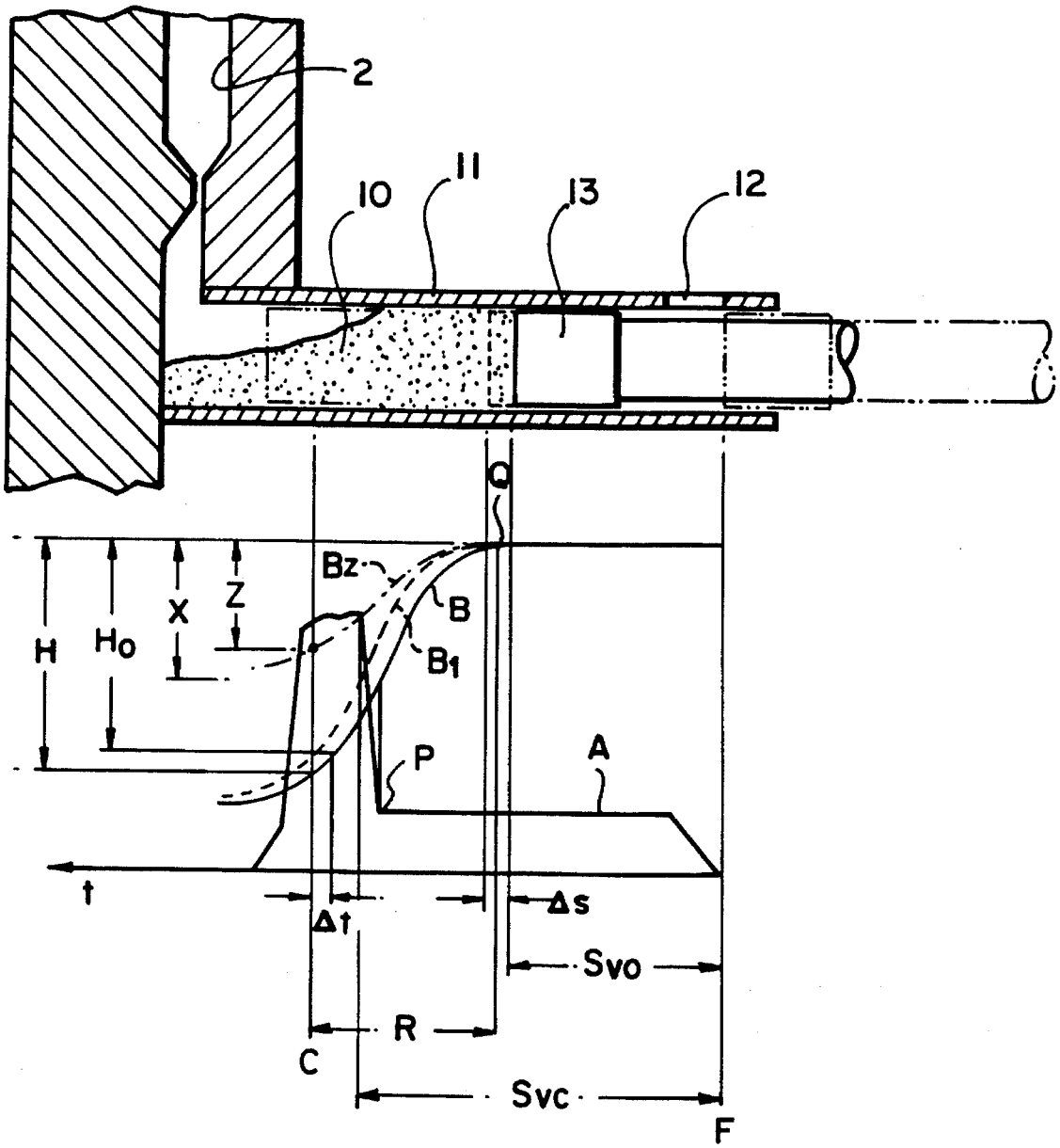
FIG. 2 is an explanatory diagram illustrating an example of a monitor screen displaying vacuum-degree curves and an injection velocity curve in the case where the degree of vacuum is higher than a preset value during an injection cycle.

Next, in connection with the injection process, the operation of the present example will now be described. FIG. 2 is a cycle chart indicating the variations of the position of the injection plunger 13, the degree of vacuum, the injection velocity of the melt, and other variables and the relationships therebetween in the casting cycle of the automatic operation of the die casting machine. In this chart, curve A represents the injection velocity, which is the velocity of the injection plunger 13. Curve B represents the degree of vacuum. In this case, the degree of vacuum is indicated by an inverted chart in which atmospheric pressure is taken as zero degree of vacuum and the degree of vacuum increases in the downward direction. The distance Svo indicates a first position of the injection plunger 13 at the instant when a signal for opening the vacuum valve 3 is outputted. The distance Svc indicates a second position of the injection plunger 13 at the instant when a signal for closing the vacuum valve 3 is outputted. Both distances Svo and Svc are those from the initial position F of the injection plunger 13.

Then, in order to first establish the initial setting of the casting cycle of the die-casting machine, data to be set such as the distances Svo and Svc and a set degree of vacuum HO are inputted beforehand from the keyboard 28.

Figure 4:
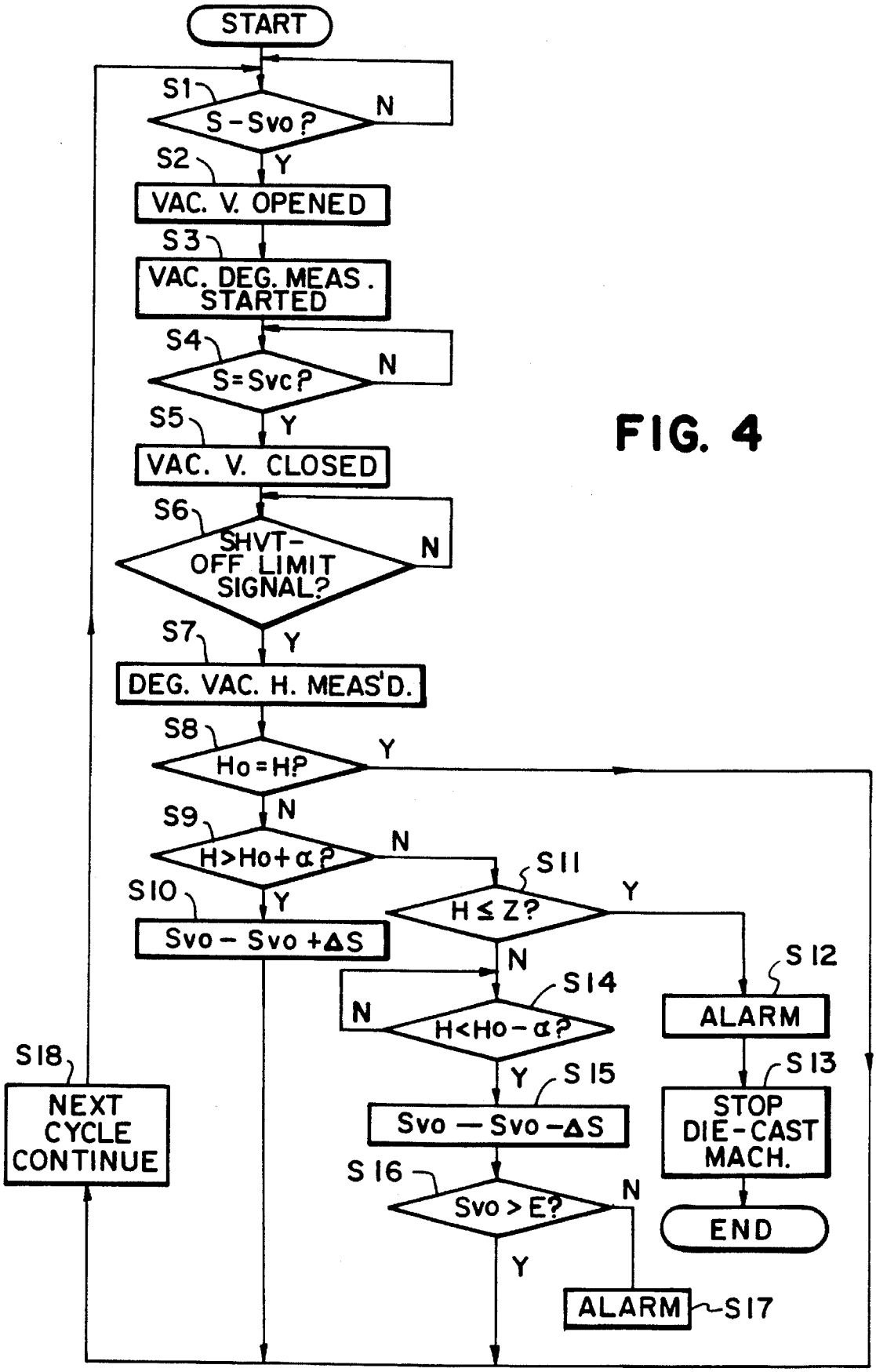
FIG. 4 is a flow chart indicating the operation of the vacuum-controlling system according to this invention.

The operation of the control device 23 will now be described with reference to the flow chart of FIG. 4. When a casting cycle is started, the position S of the injection plunger 13 is transmitted by way of the position sensor 22 to the central processing unit 25. Then, when the plunger 13 has advanced through the distance Svo, the first position of the plunger 13 is detected (step S1).

The central processing unit 25 thereupon operates, in order to open the vacuum valve 3, to output and transmit a control signal for energizing a solenoid 37*a* of the switch valve 36 to a driving circuit (not shown) (step S2), whereby the spool 32 of the vacuum valve 3 is raised by fluid pressure, and the vacuum valve 3 is opened. As a result, the cavity 2 and the vacuum tank 6 become communicative. Thereafter the interior pressure of the cavity 2 is reduced. The degree of vacuum thereof thereby becomes progressively high as indicated by curve B in FIG. 2. Simultaneously, in response to the output of the vacuum sensor 20, the measurement of the degree of vacuum thereafter is started (step S3). Data indicating the degree of vacuum is measured at unit time intervals and is stored as a table in the main memory device 26 of the control device.

As the plunger 13 advances further and reaches its second position at the distance Svc (step S4), the central processing unit 25 outputs and transmits a control signal for energizing the solenoid 37*b* of the switch valve 36 (step S5). Accordingly, the spool 32 of the vacuum valve 3 descends, and the degree of opening of the vacuum valve 3 begins to decrease to zero. The fully closed condition, i.e., the shut-off limit, of the vacuum valve 3 is detected by way of the limit switch 35*b*. When the shut-off limit signal thereof is detected (step S6), the operation advances to the next step S7. In this FIG. 2, the degree of vacuum H at this instant C is measured by the output of the vacuum sensor 20. Together with this, the value of the measured degree of vacuum H is then compared with a set value HO of the degree of vacuum set beforehand. In accordance with the result of this comparison, a process for correction, if necessary, of the first position at Svo of the injection plunger 13 corresponding to the position at which the vacuum valve is opened is carried out.

More specifically, first, in the case where the set value HO of the degree of vacuum and the detected value H are equal, including an allowance $\alpha$, as a result of the comparison of the two values ("Yes" of step S8), the operation advances to the next cycle (step S18) without correction.

In the case where the detected degree of vacuum H is higher than the set value HO, even with consideration of the allowance $\alpha$, ("Yes" of step S9), the following measure is carried out. In order to retard the timing of the opening of the vacuum valve 3, a specific correction quantity AS is added to the position Svo of the injection plunger 13 for opening the vacuum valve 3 in the succeeding injection cycle. Thus the position for opening the vacuum valve 3 in the succeeding cycle is corrected to Svo+$\Delta$S, which is shifted by $\Delta$S toward the mold side (step S10).

This correction of the first position Svo of the injection plunger 13 is carried out on the basis of vacuum degree data stored along the time axis as indicated by the vacuum degree curve B in FIG. 2. In this case, if the degree of vacuum H at the time instant C at which the vacuum valve 3 has been fully closed is higher than the preset value Ho, the difference in degree of vacuum thereof can be converted into the time lag $\Delta$t. If this time-converted $\Delta$t is considered to correspond to the correction quantity $\Delta$S of the injection plunger 13, by shifting the first position Svo by $\Delta$S toward the mold side, it can be presumed that the variation of the degree of vacuum in the succeeding injecion cycle will follow that indicated by the vacuum degree curve B1. Therefore the degree of vacuum of the time instant C at which the vacuum valve 3 becomes closed can be controleled to the present value Ho.

Figure 3:
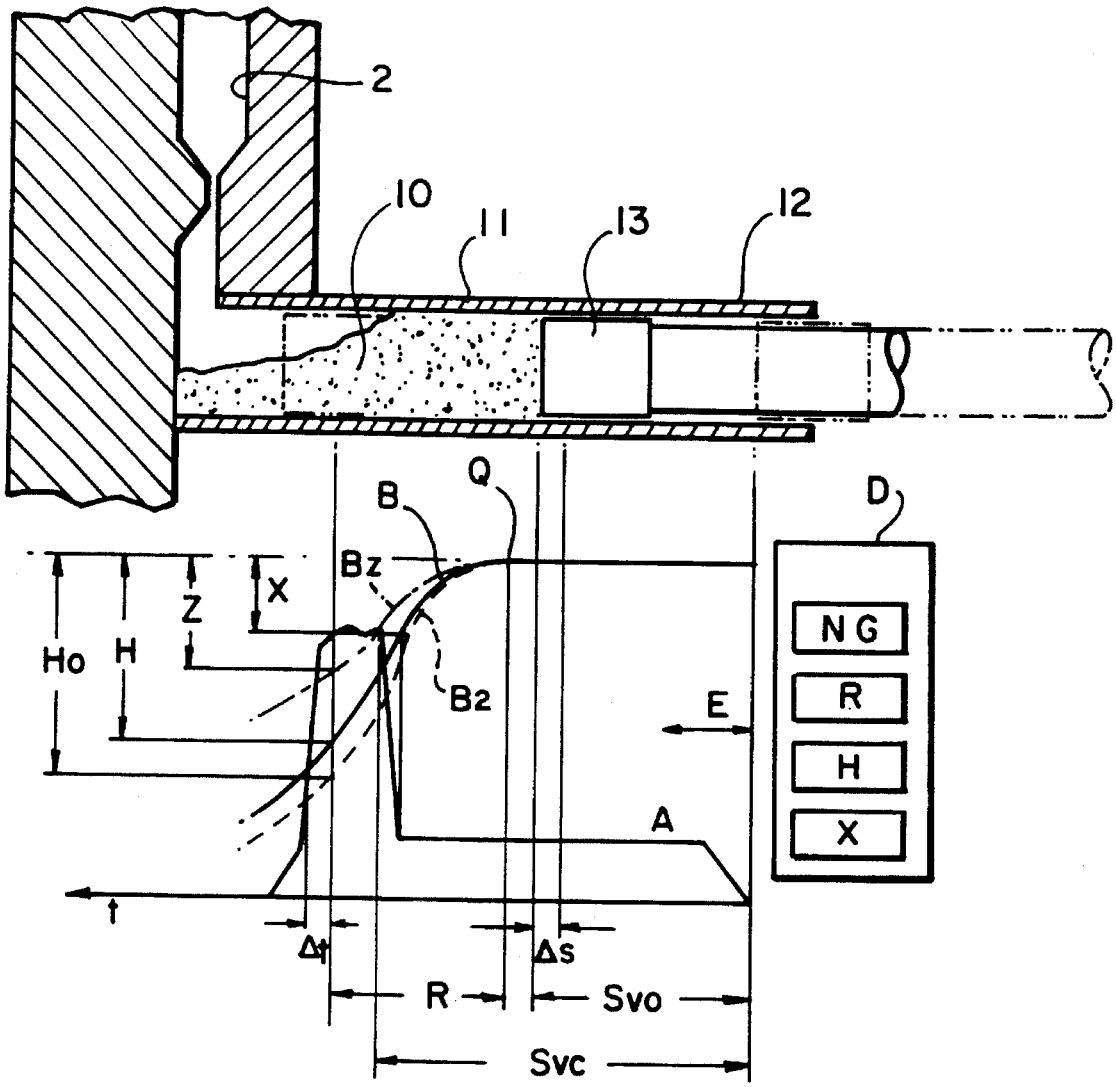
FIG. 3 is an explanatory diagram illustrating an example of a monitor screen displaying vacuum-degree curves and an injection velocity curve in the case where the degree of vacuum is lower than a preset value during an injection cycle.

On the contrary, if the value of the detected degree of vacuum H is lower than the set value HO ("No" of step S9), a correction for advancing the timing for opening the vacuum valve 3 in the succeeding cycle is carried out. FIG. 3 shows the vacuum degree curve B in the case where the degree of vacuum H is low.

More specifically, a limiting value Z of the degree of vacuum has been set beforehand as an abnormal value for excessive lowering of the degree of vacuum on the basis of the specifications of the die-casting machine and the casting conditions. In step S11, this limiting value Z and the detected value H of the degree of vacuum are compared. If the detected value H is found to be lower than the limiting value Z, this is judged to be due to clogging of the filter 8, for example, and a signal for sounding and displaying an alarm is transmitted to the sound alarm device 30 and the CRT 29 (step S12). Furthermore a signal for stopping the operation of the die-casting machine is transmitted (step S13).

On the other hand, in the case where the detected degree of vacuum H has not decreased to the limiting value Z but is lower than the set value HO, even when the allowance a is considered ("Yes" of step S14), the value of Svo is corrected to a value obtained by subtracting $\Delta$S from the value in the preceding process (step S15) in order to advance the timing of the opening of the vacuum valve 3.

Similarly as in the case illustrated in FIG. 2, in this correction of the first position Svo of the injection plunger 13, the time lag Δt is converted into the correction quantity ΔS of the position of the injection plunger 13 from vacuum degree data representable by the vacuum degree curve B and in accordance with the difference between the vacuum degree H and the present value Ho at the time instant C of full closure of the vacuum valve 3. Then the first position Svo of the injection plunger 13 is shifted by ΔS in the direction away from the mold, and the succeeding injection cycle is carried out. By this procedure, since the degree of vacuum can be predicted to vary in the manner indicated by the vacuum degree curve B2 during the next injection cycle, control of the degree of vacuum to the present value Ho becomes possible.

This stroke Svo must be greater than a certain constant value E for reasons due to the relationship with the position of the melt inlet 12. For this reason, in the succeeding step S16, the value of the stroke Svo after correction and this limiting value E are compared. If the corrected stroke Svo is found to be less than the limiting value E, an alarm signal is transmitted to the alarm device 30 (step S16).

The case where, due to some cause, the degree of vacuum in the vacuum piping 4 as detected by the vacuum sensor 20 has become high in this manner will be considered. In this case, if the casting cycle is continued with the timing of opening of the vacuum valve 3 still in its initially set state, since the lowering of the pressure in the cavity 2 occurs early, gas is apt to be sucked in through the gap between the injection plunger 13 and the injection sleeve 11, as was described hereinbefore with regard to the prior art, and to be entrapped and swept by the molten metal into the cavity 2. According to the instant example of the invention, however, since the degree of vacuum is controlled by interlocking the position of the injection plunger 13 and the timing of the opening and closing of the vacuum valve, the position of the injection plunger 13 at which vacuum valve is opened is corrected to a position advanced further toward the mold side by a specific distance value. Thus, by retarding the timing of the start of pressure reduction of the cavity 2 by the opening of the vacuum valve 3, the main cause of formation of blowholes in the cast product can be eliminated before it arises.

On the contrary, when the degree of vacuum in the vacuum piping 4 has decreased as a consequence of some cause such as clogging of the filter 8, the position of the plunger 13 for opening the vacuum valve 3 is corrected by displacement in the rearward retracting direction, whereby the timing for opening of the vacuum valve 3 can be advanced. Accordingly, the lowering of the pressure within the cavity 2 is started earlier. For this reason, the degree of vacuum in the cavity 2 can be maintained automatically with a specific constant range.

Next, the vacuum degree curves as shown in FIGS. 2 and 3 are displayed on the CRT 29, together with other data as described hereinbelow, between injection cycles.

In FIGS. 2 and 3, curves B, $B_1$, and $B_2$, $B_2$ are vacuum curves respectively representing variations with time of degrees of vacuum. Curve A is an injection velocity curve representing the variation with time of the velocity of the injection plunger 13. In the instant example, the vacuum-degree curve BZ indicates the variation with time of the degree of vacuum under certain set conditions. The vacuum-degree curve $B_1$ indicates the variation with time of the degree of vacuum based on actually measured data resulting from operation of the central processing unit 25 on the basis of the output of the vacuum-degree sensor 20. The vacuum-degree curve $B_2$ indicates the variation with time of the limit of the range of supervisory control of the degree of vacuum. When the degree of vacuum H at the instant of closure of the vacuum valve 3 has become lower than the limit value Z, the die-casting machine stops as described hereinbefore. Therefore, by displaying simultaneously the vacuum-degree curve B of actual measurement values and the vacuum-degree curves B1 and B2 predicted in the next injection cycle as a result of correction, the states of the degrees of vacuum can be visually grasped with real time.

Furthermore, the central processing unit 25 detects the instant at which the vacuum valve 3 actually opens by operationally determining the point of inflection Q of the vacuum-degree curve B. At the same time, the CPU 25 operationally determines the time interval between this point of inflection Q and the instant C of reception of the closing limit signals transmitted from the limit switch **35*b* provided at the vacuum valve 3**.

On the other hand, with respect to the injection velocity curve A, the CPU 25 operationally processes a pulse signal outputted by the position sensor 22, determining the variation point P at which the injection velocity rises abruptly from slow speed to high speed and determining the degree of vacuum X at this variation point P.

If this degree of vacuum X is excessively high, there is the undesirable possibility of the melt being injected with surplus impulse into the cavity and clogging the vacuum valve 3. Therefore, in the case where the vacuum degree X is higher than the vaccum degree H at the time instant C of closure of the vacuum valve 3, and alarm is emitted.

As is illustrated by an example in FIG. 3, in the screen of the CRT 29, a parameter display section D for displaying specific parameters for monitoring together with the above described vacuum-degree curves B and $B_2$ and the injection velocity curve A is provided. In this section D, various parameters necessary for supervision of the state of the injection cycle are displayed. Examples of the principal parameters thus displayed are the time interval R from the opening of the vacuum valve 3 to its closure, the degree of vacuum X at the instant when the injection velocity rises, and the degree of vacuum H at the instant of closure of the vacuum valve. In the undesirable event that the degree of vacuum H is lower than the limit value Z, an NG (not good) comment indicating the occurrence of a defective product is displayed.

As will be apparent from the foregoing description, the present invention provides a method and system for controlling the degree of vacuum in vacuum die casting wherein the degree of vacuum within the mold cavity is controlled at a constant value by interlocking the position of the injecton plunger and the opening and closing action of the vacuum valve, and, in accordance with the difference between that degree of vacuum and a preset degree of vacuum, varying the position of the injection plunger at which the vacuum valve opens in the succeeding injection cycle. As a result, formation of blowholes in the cast product due to gas being swept into the cavity by the injected melt can be prevented, and stabilization of the product quality of the die-cast castings can be achieved.

Furthermore, when a value of the degree of vacuum which is lower than a set value is detected, an alarm is automatically emitted. In addition, the state of the injection cycle can be supervisorily observed from the vacuum-degree curves and the injection velocity curve. Thus a stable automatic process for vacuum die casting can be realized.

What is claimed is:

1. In a vacuum die-casting method wherein, as the degree of vacuum within a cavity of a metal form is measured, opening and closing of a vacuum valve provided in a vacuum system communicating with the cavity is carried out, and, as suction is applied to evacuate the interior of the cavity, pressure forming therein of molten metal is carried out, said method comprising:

starting suction of gas within the cavity by opening the vacuum valve when an injection plunger has advanced to a first position;

stopping the suction of the gas within the cavity by closing the vacuum valve when the injection plunger has reached a second position;

at substantially the same time, comparing the degree of vacuum within the vacuum system at the time instant when the injection plunger reaches this second position with a preset degree of vacuum;

varying the first position a specific distance toward the metal mold side in a case where the degree of vacuum at the second position is high;

varying the first position by a specific distance away from the metal mold side in a case where the degree of vacuum is low thereby to adjust the opening and closing of the vacuum valve; and carrying out pressure forming in a succeeding injection step as the degree of vacuum in the cavity of the metal mold is maintained at a specific value by interlocking the corrected first and second positions with the opening and closing of the vacuum valve.

2. A vacuum die-casting method according to claim 1 further comprising:

setting beforehand the second position of the injection plunger;

measuring the vacuum-degree data along a time axis from a start of the injection step;

comparing the degree of vacuum at the second position of said injection plunger with a preset value;

converting into time the difference between the degrees of vacuum based on the vacuum-degree data;

converting this time-converted value into a correction value of the position of the injection plunger thereby to revise the first position of the injection plunger in the succeeding injection process cycle; and interlocking the position of the injection plunger and the timing of the opening and closing of the vacuum valve in the injection process cycle.

3. In a vacuum die-casting apparatus provided with a vacuum valve for carrying out opening and closing of a vacuum system communicating with the cavity, and a vacuum device for applying suction via said vacuum system so as to create a vacuum within the cavity, said apparatus comprising:

vacuum-degree detecting means for detecting a degree of vacuum within the vacuum system;

position detecting means for detecting a position of an injection plunger;

memory means for storing detected vacuum-degree data at unit time intervals from a start of an injection process cycle;

vacuum-degree comparison means for comparing a degree of vacuum at a time instant of closure of the vacuum valve and a preset degree of vacuum; and position correction means operating, in the case where the degree of vacuum detected on the basis of the vacuum-degree data is higher than the preset degree of vacuum, for shifting a first position of the injection plunger for opening the vacuum valve by a specific distance toward the metal mold side and, in the case where the detected degree of vacuum is lower than the preset degree of vacuum, shifting the first position by a specific distance away from the metal mold side in the succeeding injection process cycle.

4. A vacuum-controlling system according to claim 3, further comprising a shut-off limit detector for detecting a fully closed state of the vacuum valve and accordingly generating a shut-off limit signal, said vacuum-degree degree comparison means operating in response to the shut-off limit signal to compare the degree of vacuum H after detection of the shut-off limit and a previously set limiting value Z of degree of vacuum.

5. A vacuum-controlling system according to claim 3 or 4, further comprising an alarm signal generating means for generating at least one of an alarm signal and a signal for stopping the die-casting machine when the detected degree of vacuum is lower than the limiting value Z and alarm devices operating in response to the alarm signal to emit alarms.

6. A vacuum-controlling system according to claim 3, further comprising:

processing means for operationally processing a variation with time of the degree of vacuum in the vacuum system, the velocity of said injection plunger, and parameters indicating the state of the injection cycle of the molten metal into the cavity based on the vacuum-degree data stored in said memory means and the output data of said position detector, said processing means thereby generating corresponding outputs; and a display device operating in accordance with said outputs of said processing means to display a vacuum curve indicating the variation with time of the degree of vacuum, an injection velocity curve indicating the variation with time of the velocity of said injection plunger, and said parameters.

7. A vacuum-controlling system according to claim 6, wherein said processing means comprises a central processing unit and a main memory device both connected via an input port to said vacuum detector, said shut-off limit detector, said position detector, and a keyboard device for inputting preset data for vacuum control and via an output port to said alarm devices, said display device, and said vacuum valve.

8. A vacuum-controlling system according to claim 4, further comprising:

processing means for operationally processing a variation with time of the degree of vacuum in the vacuum system, the velocity of said injection plunger, and parameters indicating the state of the injection cycle of the molten metal into the cavity based on the vacuum-degree data stored in said memory means and the output data of said position detector, said processing means thereby generating corresponding outputs; and a display device operating in accordance with said outputs of said processing means to display a vacuum curve indicating the variation with time of the degree of vacuum, an injection velocity curve indicating the variation with time of the velocity of said injection plunger, and said parameters.

9. A vacuum-controlling system according to claim 8, wherein said processing means comprises a central processing unit and a main memory device both connected via an input port to said vacuum detector, said shut-off limit detector, said position detector, and a keyboard device for inputting preset data for vacuum control and via an output port to said alarm devices, said display device, and said vacuum valve.

10. A vacuum-controlling system according to claim 5, further comprising:

processing means for operationally processing a variation with time of the degree of vacuum in the vacuum system, the velocity of said injection plunger, and parameters indicating the state of the injection cycle of the molten metal into the cavity based on of the vacuum-degree data stored in said memory means and the output data of said position detector, said processing means thereby generating corresponding outputs; and a display device operating in accordance with said outputs of said processing means to display a vacuum curve indicating the variation with time of the degree of vacuum, an injection velocity curve indicating the variation with time of the velocity of said injection plunger, and said parameters.

11. A vacuum-controlling system according to claim 10, wherein said processing means comprises a central processing unit and a main memory device both connected via an input port to said vacuum detector, said shut-off limit detector, said position detector, and a keyboard device for inputting preset data for vacuum control and via an output port to said alarm devices, said display device, and said vacuum valve.

* * * * *